United States Patent [19]

Ludvigson

[11] 4,376,527

[45] Mar. 15, 1983

[54] DEVICE FOR TENSIONING A REINFORCING STRAND

[76] Inventor: Birger Ludvigson, Södra Vägen 38, Göteborg, Sweden, S-41254

[21] Appl. No.: 177,767

[22] PCT Filed: Mar. 26, 1979

[86] PCT No.: PCT/SE79/00067

§ 371 Date: Nov. 16, 1979

§ 102(e) Date: Nov. 16, 1979

[87] PCT Pub. No.: WO79/00856

PCT Pub. Date: Nov. 1, 1979

[30] Foreign Application Priority Data

Mar. 31, 1978 [SE] Sweden ..... 7803640

[51] Int. Cl.[3] ..... B28B 23/04; F01B 1/01

[52] U.S. Cl. ..... 254/29 A; 60/632; 60/39.461; 91/402; 254/93 R

[58] Field of Search ..... 140/123.5; 254/29 R, 254/29 A, 93 R; 60/632–638, 39.46 R, 39.46 S; 91/402, 135

[56] References Cited

U.S. PATENT DOCUMENTS 4,048,706 9/1977 Ludvigson ..... 254/29 A

FOREIGN PATENT DOCUMENTS 1109566 1/1956 France ..... 60/632
176380 8/1961 Sweden ..... 254/29 A
395496 8/1977 Sweden .

*Primary Examiner*—Kenneth J. Ramsey
*Attorney, Agent, or Firm*—Cantor and Singer

[57] ABSTRACT

A device for tensioning reinforcing strands in concrete structures comprises a cylinder and a cooperating piston and is provided with means for supplying a pressure gas obtained by the combustion of powder or some similar compound. The device may be arranged so either the piston or the cylinder is movable, and by selecting the size and the composition of the powder charge it will be possible to use the device for an initial tensioning, usually performed in a number of steps, as well as for a final jerk. The device may be provided with an abcumulator, at which she combusthon obcurs, the devhbe bdhmg orovhded with means for permitting, at will, the gas from the accumulator to act upon the piston.

8 Claims, 3 Drawing Figures

DEVICE FOR TENSIONING A REINFORCING STRAND

Figure 1:
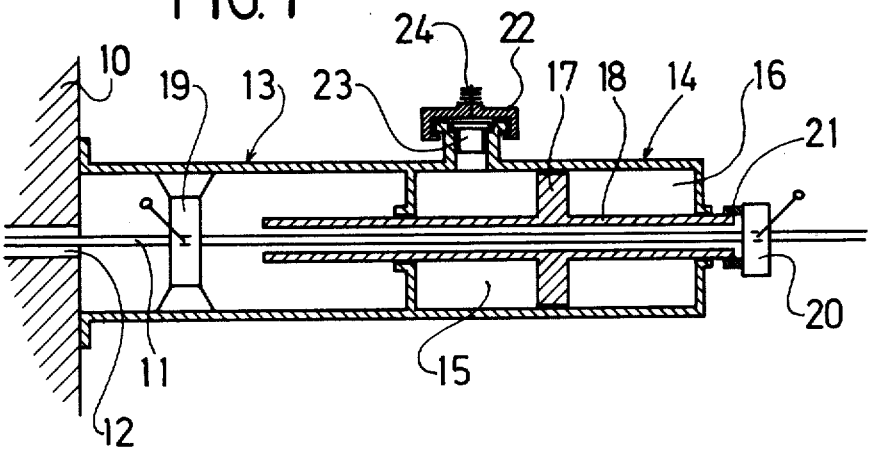

Reinforcing strands in concrete structures are often subjected to a tensioning action during the erection. On those occasions when the reinforcing strands are located in passages in the concrete structure, and the casting of the latter is completed before tensioning is applied to the strands, it will, especially with long strands, and with strands which do not run rectilinearly, be found that friction against the walls of the passages causes a very uneven stress distribution along the length of the individual strand. The tension is highest at the end where the pulling force is applied, and the tension will be reduced in the direction away from said end.

In order to bring about a levelling of the stress distribution along the strand the inventor has previously proposed to terminate the static, stepwise tensioning by a sudden stress change, which causes a shock wave to pass along the strand. During a short moment of time this shock will release the local frictional grips between the passage walls and the strand.

When this activity is terminated the passage is filled with concrete slurry so the strand will be firmly bonded to the structure.

This shock wave has been caused by a hydraulic ram, sometimes subjected to the action of a pressurized gas, stored in a container. A shock wave for causing the desired stress relieving in the strand has a very short duration—it is a question of parts of a second—and experience has shown that it is very difficult to accelerate the means for jerking the strand. The rapid sequence will further make it necessary to use short conduits and large flow areas.

A substantial simplification of the handling is obtainable according to the invention by using a device for tensioning the strands and being provided with means adapted to supply the cylinder with gas obtained by the burning of powder or some similar substance.

A satisfactory tensioning of a strand will comprise a static tensioning, usually performed in several steps, followed by at least one jerk.

For the static tensioning a double acting ram of arbitrary type may be used, and the aim of the present invention is, in the first hand, to propose a device for causing the jerk, which in a simple manner may be devised so it can be used for the static tensioning also.

According to a development of the invention the device may include an accumulator, at least one portion of which forms an axial extension of its cylinder. A support determining the inward movement of the piston into the cylinder is then formed as a fixed annular flange between the cylinder and the accumulator, and a cooperating slave piston is adapted to form a temporary seal between the cylinder and the accumulator, said slave piston turning a smaller surface towards the accumulator, than towards the cylinder of the ram.

A connecting duct having a governing valve may be provided for occasionally communicating the accumulator with a space between the support flange and the slave piston.

The means for governing the length of the piston stroke may comprise a stop member, cooperating with the piston rod and determining the return movement of the piston into the cylinder. Alternatively series of exhaust openings may be provided in the cylinder wall, a slide being arranged to maintain, at will some openings free and others closed.

The device may alternatively include a stationary piston and an enclosing cylinder, which at one end is formed with means for the attachment of the ends of a number of strands, while its other end includes a bottom structure comprising at least one loading chamber, which may be closed by a breech mechanism.

The cylinder is preferably provided with a number of exhaust ports in its shell, located at a distance from the bottom structure corresponding to the desired stroke.

The exhaust ports may be arranged in series at varying distances from the bottom structure, and a closure means is provided to select one series, while closing the remaining ports, to make possible a variation of the stroke length.

The cylinder may be provided with a firing mechanism communicating with the combustion chamber by a passage directed towards the end of the powder charge protruding into the combustion chamber.

Figure 2:
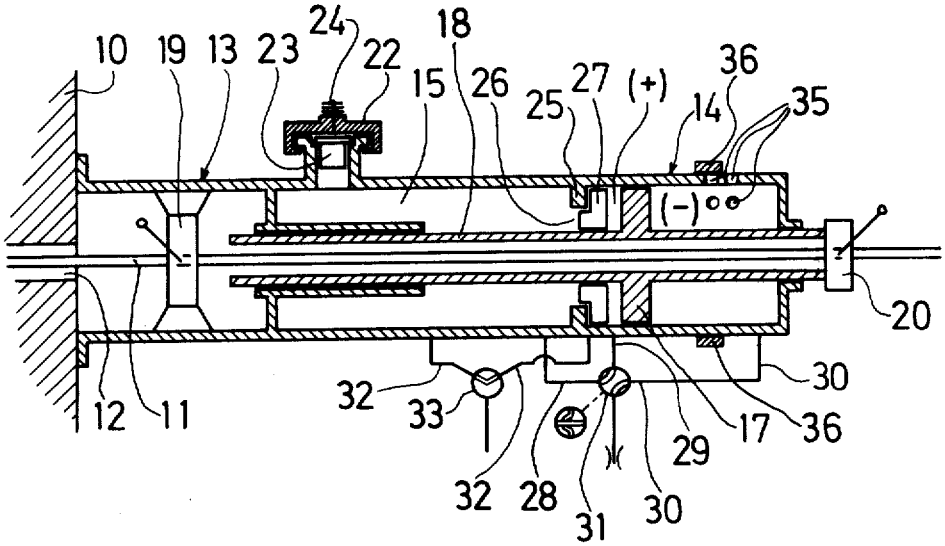
Figure 3:
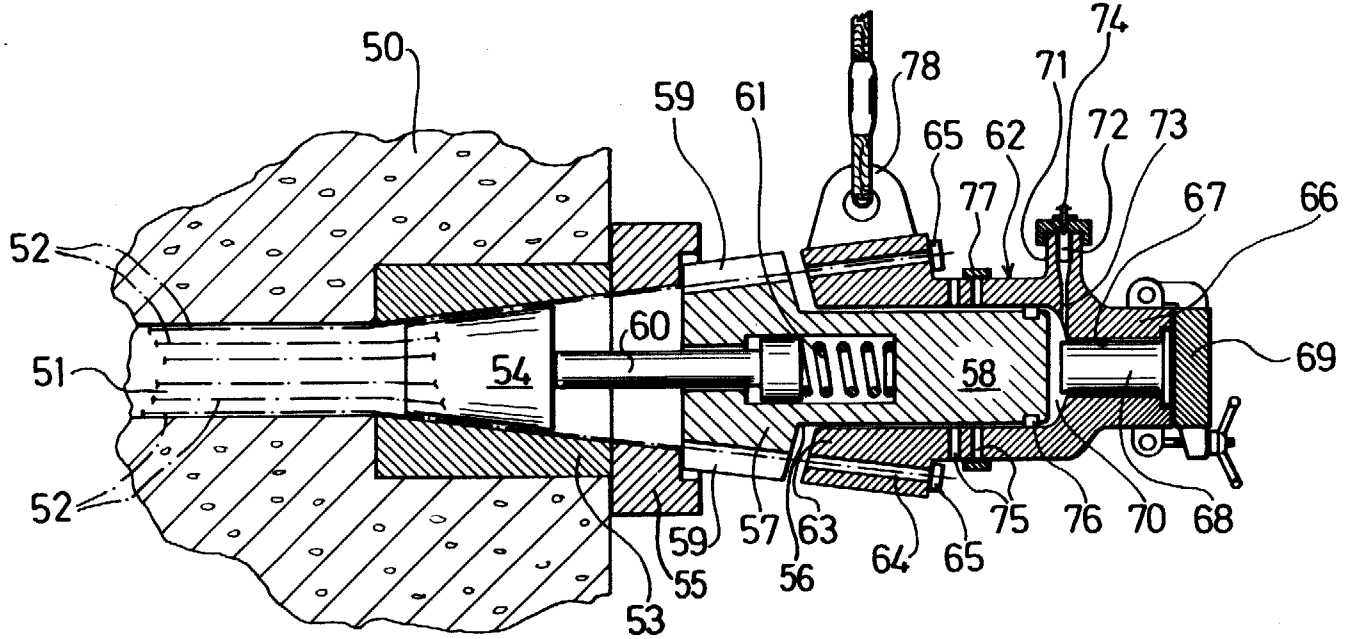

Three embodiments of the invention will below be described with reference to the accompanying drawings, in which FIG. 1 shows a device, actuated by powder gas, and adapted to be used for the static tensioning as well as for the jerk, FIG. 2 shows a modified embodiment of the arrangement according to FIG. 1, and FIG. 3 shows a device where the cylinder is moveable in relation to the stationary piston.

In FIG. 1, 10 denotes a portion of concrete structure, which is to be reinforced by a reinforcing strand 11, which extends through a passage 12 in the structure. It is presupposed that the opposite end of the strand is firmly anchored to the structure.

The tensioning is caused by a device, generally denoted by 13, and provided with supporting legs for engagement with the concrete structure. The device comprises a ram 14, which may be used for the static tensioning, as well as for the jerk.

The ram 14 includes a cylinder 15, 16 and a piston 17 operating therein, the piston being mounted upon a tubular piston rod 18. This encloses the end of strand 11 and passes sealingly through end plates, outwardly defining the ram 14 proper and an accumulator part 15. Obviously the strand may be lengthened outside of the concrete structure by an extension member, the latter then passing through the ram. Piston rod 18 has a sufficient length to maintain its sealing contact with the end plates during the stroke movements of piston 17.

Beyond the path of the piston rod there is a first locking member 19, by means of which the strand 11 can be obtained after a tensioning step, while piston 17 is returned in preparation for the next step. There are several kinds of suitable locking members, so no detailed description is considered necessary.

A second locking member 20 is attachable to strand 11, or possibly upon piston rod 18, outside of the ram. The second member 20 locks strand 11 before piston 17 performs its active stroke, and will retain the strand so the first locking member 19 may be set free. When the piston has performed its stroke the second member 20 (with the end of the strand) has been pushed a corresponding distance away from the ram.

Locking members 19 and 20 will thus be closed and opened, respectively, in step with the extension of the strand's end away from the concrete structure.

The end of piston rod 18 extending out of ram 14 is provided with a stop 21, which determines how far piston 17 may be retracted into the cylinder. The stop 21 may be designed in such a manner that it becomes adjustable in the axial direction of the rod, and will determine the efficient length of the piston stroke.

The portion of ram 14 located between piston 17 and the supporting legs is formed as a pressure chamber, which will be charged by gas obtained by the burning of powder, or some other suitable substance. A breech lock mechanism 22 is mounted at the wall of chamber 15. The charge may be formed as powder bags, cartridges 23 or fuse like units having a suitable size and composition for causing the desired result. It may be ignitied by means of a firing pin 24, or in any other suitable manner.

The size and the shape of the charge is selected so the gases, during an ordinary tensioning stroke provides a moderate piston speed. The return stroke of the piston may be obtained in any suitable manner, not shown in the drawing. For the jerking action a rapidly burning powder charge is used, producing gases which provide a predetermined pressure sequence. By using a suitable charge it is possible to obtain not only the pulling force desirable on each occasion, but also a desired shape of the pressure curve.

For the sake of simplicity the drawing shows a single strand only, but it is evident that the device may be adapted for simultaneously tensioning a number of parallel strands located in the same passage.

FIG. 2 shows a more sophisticated arrangement of the basic design illustrated in FIG. 1. Chamber 15 is here formed as an accumulator and between the latter and cylinder 16 of the ram there is an annular support flange 25, which replaces stop 21 at the embodiment in FIG. 1, and which will limit the inward movement of piston 17.

This support flange has such an extension in the radial direction, that a passage 26, having a large flow area, will be provided. This passage may be closed by a stepped slave piston 27, which cooperates with piston 17 of the ram during the jerking action only. The slave piston 27 turns it bigger end face towards the ram cylinder 16, and its smaller face towards accumulator cylinder 15, and is furthermore adapted to sealingly engage support flange 25, against which it is normally forced by the pressure in the ram cylinder.

For the sake of simple understanding the space between piston 27 and ram piston 17 is termed the plus side (a supply of pressurized fluid here will tension the strand), while the space at the opposite side of the ram piston is termed the minus side (a supply of pressurized fluid here will cause the piston to return from its active stroke).

As chamber 15 here is formed as an accumulator it is possible, by burning a certain amount of powder, to obtain a volume of gas, which is sufficient to perform one or several strokes. The gas pressure may be augmented by burning a further charge.

A conduit 28 and branch conduits 29, 30 extending therefrom communicate accumulator chamber 15 with the plus and the minus sides of ram cylinder 16. A multiple way valve 31 governs the flow of gas from the accumulator chamber to the ram in such a manner that its piston 17 will be moved forwards and backwards, as desired, for performing the static tensioning.

A further conduit 32 communicates the accumulator chamber 15 with the space between support flange 25 and slave piston 27. Gas flow through conduit 32 is governed by means of a valve 33. During the static tensioning conduit 32 between the valve 33 and said space is open to the atmosphere in order to ensure a contact pressure and sealing between flange 25 and slave piston 27.

When valve 33 is opened gas will flow from the accumulator to the space at the back of the slave piston 27 and lifts the same away from support flange 25. The pressurized gas in the accumulator can then act against the full area of the slave piston, and there is a rapid flow of gas through passage 16. The slave piston 27 will bring the ram piston 17 along, and this movement is, in the manner above described, transferred to the strand, which will be subjected to a sudden jerk, which like a wave travels along the strand and brings about the desired equalization of local stress accumulations in the latter.

FIG. 3 shows a modified embodiment of a device, in which the cylinder is movable in relation to a stationary piston.

Each passage in the concrete structure may hold a number of parallel strands, and FIG. 3 shows a portion of a concrete structure 50, where each passage 51 encloses a number of strands 52.

Each passage 51 is terminated by a support 53 mounted flush with the wall face and provided with an inwardly tapering opening. The individual strands 52 are lead outwards along the wall of said opening, and may be locked against this wall by means of a conical wedge 54, which will be driven into the support after each tensioning operation. Care must be taken that sufficiently long ends of the strand protrude from the support 53 to make possible a satisfactory attachment to the tensioning device.

A support ring 55 is mounted at the outward face of the support 53, and a piston member 56, comprising a head 57 and a piston body 58, is attached to the support ring 55.

The head 57 has a bigger circumference than the piston body 58 and is provided with a number of grooves 59 through which the ends of strands 51 may pass freely. An axially displaceable plunger 60 is fitted in the piston head and is biased by a spring 61 towards wedge 54.

During a tensioning of strands 52, wedge 54 will be pulled free, and will compress spring 61 by way of the plunger. When the tensioning is terminated spring 61 and plunger 60 will force wedge 54 into the support opening, thereby locking the strands in their new position. Instead of using a spring 61 for acting upon the plunger, it is possible to use a pressure fluid, which may be governed in known manner so the action upon the wedge will be more precise and forceful.

The piston body 58 is enclosed by a cylinder 62, which at its end turned towards the head 57 of the piston member is formed as a radially outwards directed flange 63. This is provided with a number of through bores 64 for the strand ends, which will be individually locked in relation to the flange by suitable members 65 of arbitrary known type.

An axially directed loading chamber 67 is formed in the bottom structure 66 outwardly defining cylinder 62. A stick of powder 68 or a cartridge may be fitted into this chamber, which is then closed by a breech mechanism 69 of suitable known type.

In the starting position a combustion chamber 70 will remain between the bottom structure 66 and the end face of the piston member, and the stick of powder 68 will reach into this combustion chamber. An ignition mechanism 71, containing a firing cartridge 72 is attached to the cylinder, and communicates with the combustion chamber by way of a passage 73, directed towards the stick of powder. Hereby an ignition of the stick of powder will occur at the end of the stick projecting into the combustion chamber.

In order to facilitate use of charges of different magnitude a number of parallel chambers may be provided in the bottom structure of the cylinder.

The firing cartridge 72 may be ignited in any suitable manner, for instance by way of an electrically activated firing pin 74. The issuing hot jet of gas will sweep around the combustion chamber and ignite the stick of powder 68.

Safety devices (not shown) will prevent initiation of firing cartridge 72 if the stick of powder has not been properly lodged and/or if the breech mechanism 69 has not been safely closed.

A number of exhaust ports 75 are provided in the envelope wall of cylinder 62. When these openings, during an outward movement of the cylinder, have passed sealing means 76 at the outward end of piston member 58 the gases will be exhausted to the atmosphere, and the outward movement of the piston will cease. The ports may be arranged in series at different distances from the bottom structure. A mechanism, for instance a slidable ring 77, is then provided, by means of which one series may be kept open, while the other ports are closed, whereby a variation of the stroke length is obtainable.

By selecting the size and the composition of the powder charge it is possible to use a device of this type for the initial tensioning as well as for the final jerk.

After an outward stroke the cylinder will be brought back to its initial position by suitable means of known type (not shown). With vertically running strands the device will be mounted vertically, and when the breech mechanism 69 has been opened and residues of powder or a possible protecting cartridge for the stick of powder have been removed hardly any force will be needed to push the cylinder downwards.

When a horizontal positioning is desirable the device will be hung in an ear 78 attachable to a chain or the like, but also with this arrangement small force will be needed to push the cylinder inwards.

The drawings are very schematic and only intended to illustrate the various functions. The shape and size of the individual components may therefore, within the scope of the appended claims, vary in the practical embodiment.

Means for governing the pressure, safety valves and other monitoring equipment, as well as means with the embodiments according to FIG. 1 for causing and controlling the gas expulsion from the minus side of the ram, during the jerk will be included, but have not been shown.

On certain occasions it may be desirable to limit the stroke of piston during the jerk. This may be arranged by enclosing an amount of gas in the minus part of the ram, to act as a pneumatic bumper. Ideal pressure sequences during the jerk will be obtained by selecting the composition and the size of the powder charge.

After the initial static tensioning it may on one occasion be desirable that the pressure-in spite of the increasing volume of the plus space in the ram-rapidly rises and then is maintained substantially constant, or rises rectilinearly to a novel value. On an other occasion it may be desirable that the pressure first rapidly rises to a high value, and then gradually sinks, substantially to the pressure prevailing at the end of the static tensioning. The time slotted for pressure increase and for pressure reduction, respectively, will depend upon local condition.

I claim:

1. A device for tensioning a reinforcing strand in a concrete structure with a terminating jerk by means of a ram attachable to the end of the strand and comprising a cylinder, a piston cooperating therewith, means for accepting a charge of combustible material which produces combustion gas upon burning and for supplying said gas to the cylinder, and means for limiting the length of the stroke of the piston when subjected to the influence of the gas, said means for limiting the stroke of the piston comprising a series of exhaust openings in the wall of the cylinder, located at different axial distances from the gas inlet end of the cylinder, as well as a slide manipulable to maintain at least one of said series open.

2. A device for tensioning a reinforcing strand in a concrete structure by means of a ram attachable to the end of the strand and comprising a cylinder; a piston cooperating therewith; means for accepting a charge of combustible material which produces combustion gas upon burning and for supplying said gas to the cylinder; said piston being stationary and said cooperating cylinder being axially movable in relation thereto; said cylinder being provided, at one end, with means for the attachment of the ends of a number of said strands and at its opposite end being formed with a bottom structure containing said means for accepting a charge; said means for accepting a charge comprising at least one loading chamber and a cooperating breech mechanism; a number of exhaust ports in the cylinder wall, located at an axial distance from the bottom structure corresponding to the desired stroke of the cylinder, the exhaust ports being arranged in series at different distances from the bottom structure; and a means for maintaining at will, one of said series open, while closing the remainder of the ports.

3. A device for tensioning a reinforcing strand in a concrete structure by means of a ram attachable to the end of the strand and comprising a cylinder; a piston cooperating therewith; means for accepting a charge of combustible material which produces combustion gas upon burning and for supplying said gas to the cylinder; and adjustable means for limiting the length of the stroke of the piston when subjected to the influence of the gas by blowing off gas; said piston being stationary with respect to the concrete structure and said cooperating cylinder being axially movable in relation thereto; said cylinder being provided, at one end with means for the attachment of the ends of a number of strands and at its opposite end being formed with a bottom structure containing said means for accepting a charge; said means for accepting a charge comprising at least one loading chamber for receiving a charge of powder, the chamber being open towards the piston and outwardly closeable by a cooperating breech mechanism.

4. A device according to claim 1, 2 or 3, in combination with a powder charge with burning characteristics such that the pressure rises rapidly and then remains constant during the remainder of the jerk, and means to ignite the powder charge.

5. A device according to claim 1, 2 or 3, in combination with a powder charge with burning characteristics such that the pressure rises rectilinearly to a desired, final value, and means to ignite the powder charge.

6. A device according to claim 1, 2 or 3, in combination with a powder charge with burning characteristics such that the pressure rises to a desired value, and then is permitted to sink, substantially to the initial value, and means to ignite the powder charge.

7. A device according to claim 3, further comprising a number of exhaust ports in the cylinder wall, located at an axial distance from the bottom structure corresponding to the desired stroke of the cylinder.

8. A device according to claim 2 or 3 further comprising a firing mechanism attached to the cylinder (62) and communicating with the combustion chamber formed between the cylinder and the piston by way of a passage, for igniting the, or each, charge at the end thereof exposed at the open end of the chamber.

* * * * *